US009371156B2

(12) United States Patent
Moir et al.

(10) Patent No.: US 9,371,156 B2
(45) Date of Patent: Jun. 21, 2016

(54) ACCESSIBLE STORAGE AND DISPLAY BOX

(71) Applicant: United Surgical Associates, Inc., Solvang, CA (US)

(72) Inventors: Russell S. Moir, Solvang, CA (US); Bryan K. Bowman, Roann, IN (US)

(73) Assignee: United Surgical Associates, Inc., Solvang, CA (US)

( * ) Notice: Subject to any disclaimer, the term of this patent is extended or adjusted under 35 U.S.C. 154(b) by 0 days.

(21) Appl. No.: 14/540,270

(22) Filed: Nov. 13, 2014

(65) Prior Publication Data

US 2015/0136632 A1 May 21, 2015

Related U.S. Application Data

(60) Provisional application No. 61/906,208, filed on Nov. 19, 2013.

(51) Int. Cl.

| | |
|---|---|
| ***B65D 73/00*** | (2006.01) |
| ***B65D 25/22*** | (2006.01) |
| ***B65D 43/16*** | (2006.01) |
| ***B65D 43/22*** | (2006.01) |

(52) U.S. Cl.

CPC ..... *B65D 25/22* (2013.01); *B65D 43/162* (2013.01); *B65D 43/165* (2013.01); *B65D 43/22* (2013.01)

(58) Field of Classification Search

CPC ..... B65D 73/0064; B65D 73/0092; B65D 5/0085; B65D 43/26; B65D 43/265; B65D 2575/365; B65D 2575/368; B65D 75/56; B65D 45/22; B65D 45/20; B65D 45/18; B65D 45/16

USPC ..... 206/806, 470; 220/324, 326, 254.5, 220/254.3, 254.1, 827, 810

See application file for complete search history.

(56) References Cited

U.S. PATENT DOCUMENTS

| | | | | |
|---|---|---|---|---|
| 4,832,301 | A | 5/1989 | Hiramoto et al. | |
| 5,133,454 | A | 7/1992 | Hammer | |
| 5,209,354 | A * | 5/1993 | Thornhill et al. | 206/469 |
| 5,451,379 | A * | 9/1995 | Bowlin, Jr. | 422/297 |
| 5,964,350 | A * | 10/1999 | LaMarche et al. | 206/470 |
| 6,517,038 | B1 | 2/2003 | Pomerantz | |
| 7,044,328 | B1 * | 5/2006 | Ciavarella | 220/835 |
| 7,624,875 | B1 * | 12/2009 | Hine et al. | 206/705 |
| 8,091,700 | B2 * | 1/2012 | Nardozza | 206/1.7 |
| 8,186,509 | B2 * | 5/2012 | Samelson | 206/326 |
| 2004/0217023 | A1 | 11/2004 | Fagg et al. | |

* cited by examiner

*Primary Examiner* — Anthony Stashick
*Assistant Examiner* — Robert Poon
(74) *Attorney, Agent, or Firm* — Felix L. Fischer

(57) ABSTRACT

An accessible display box employs a front portion attached to a rear portion with a hinge. A front hanger bar receiver is centered in a top rim of the front portion and a rear hanger bar receiver extends from the rear portion aligned with the front hanger bar receiver. A releasable engagement mechanism secures the front portion and rear portion allowing the box to be easily opened for access to the carried product.

10 Claims, 9 Drawing Sheets

ACCESSIBLE STORAGE AND DISPLAY BOX

REFERENCE TO RELATED APPLICATIONS

This application relies on the priority of U.S. provisional application Ser. No. 61/906,208 filed on Nov. 19, 2013 the disclosure of which is incorporated herein by reference.

BACKGROUND INFORMATION

1. Field

Embodiments of the disclosure relate generally to the field of display boxes for product sales and more particularly to a box providing display and access to a displayed product having 2. Background Display boxes for many products including orthopedic braces and similar products are typically fabricated to securely contain the product prior to sale. This typically precludes a purchaser from extracting the product from the display box to confirm size or to allow manipulation of operating elements of the product to determine if the product is suitable for their use, or, the product packaging may be damaged by the sales person or customer attempting to extract the product which then renders the item non-salable without replacement of the packaging if the customer elects not to purchase.

It is therefore desirable to provide a display box which provides visibility of the product on display but also allows easy removal and replacement of the product for pre-purchase examination.

SUMMARY

Embodiments disclosed herein provide an accessible display box having a front portion attached to a rear portion with a hinge. A front hanger bar receiver is centered in a top rim of the front portion and a rear hanger bar receiver extends from the rear portion aligned with the front hanger bar receiver. A releasable engagement mechanism secures the front portion and rear portion allowing the box to be easily opened for access to the carried product.

The features, functions, and advantages that have been discussed can be achieved independently in various embodiments of the present disclosure or may be combined in yet other embodiments further details of which can be seen with reference to the following description and drawings.

DETAILED DESCRIPTION

Embodiments disclosed herein provide a clear storage and display box for sales of orthopedic braces and similar goods.

The box allows easy access to the product for viewing and testing of size and manipulation of adjustment elements for confirmation prior to purchase. The box has a front portion and a mating rear portion. A molded front hanger bar receiver extends from the front portion. A flexible rear hanger bar receiver extends from the rear portion and is aligned with the front receiver to support the box in a vertical position. A push panel is provided that when depressed disengages the front and rear portions allowing them to be separated, rotating along a bottom hinge.

Figure 1A:
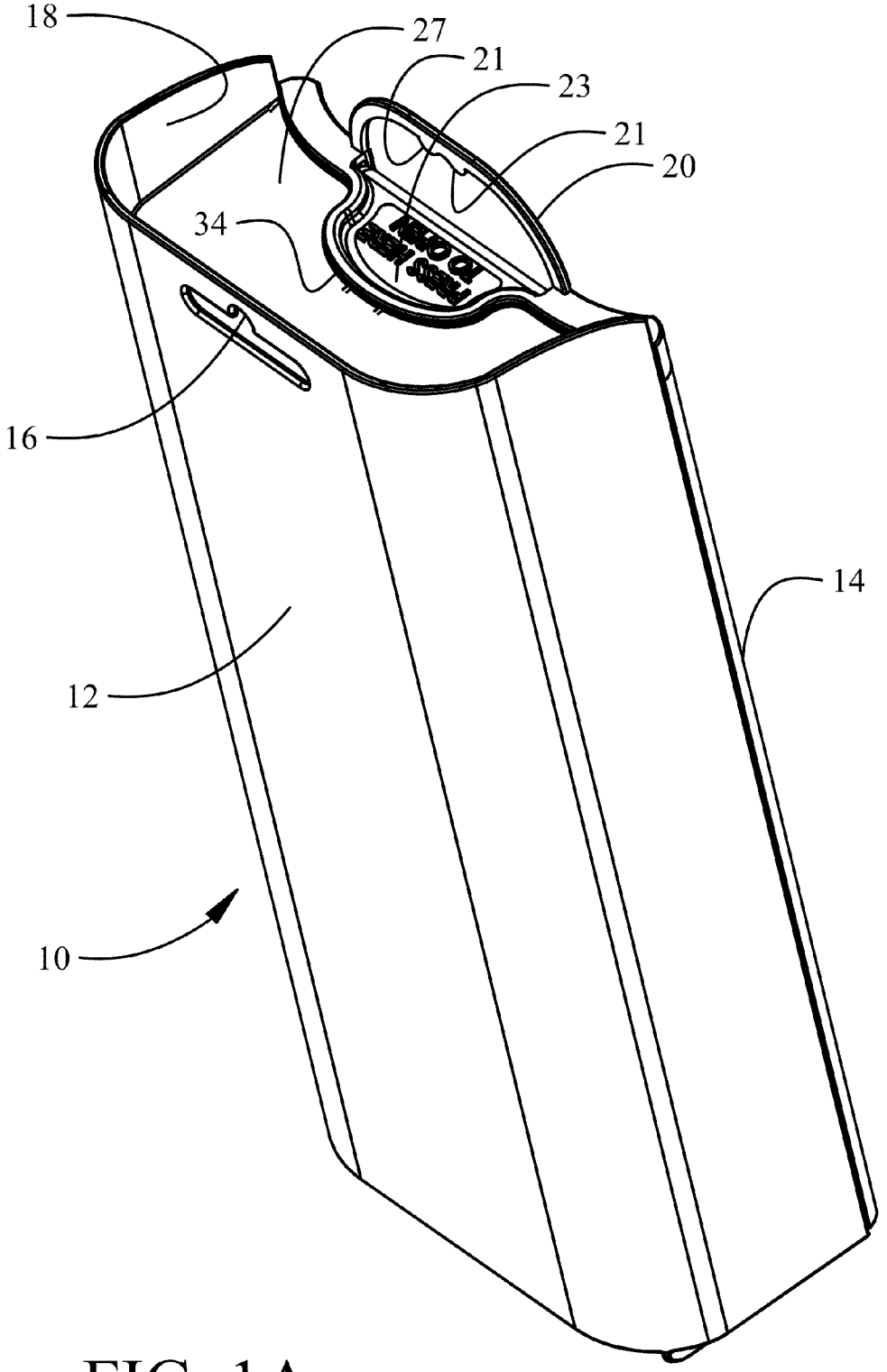
FIG. 1A is a top pictorial representation of an embodiment for the accessible storage and display box.
Figure 1B:
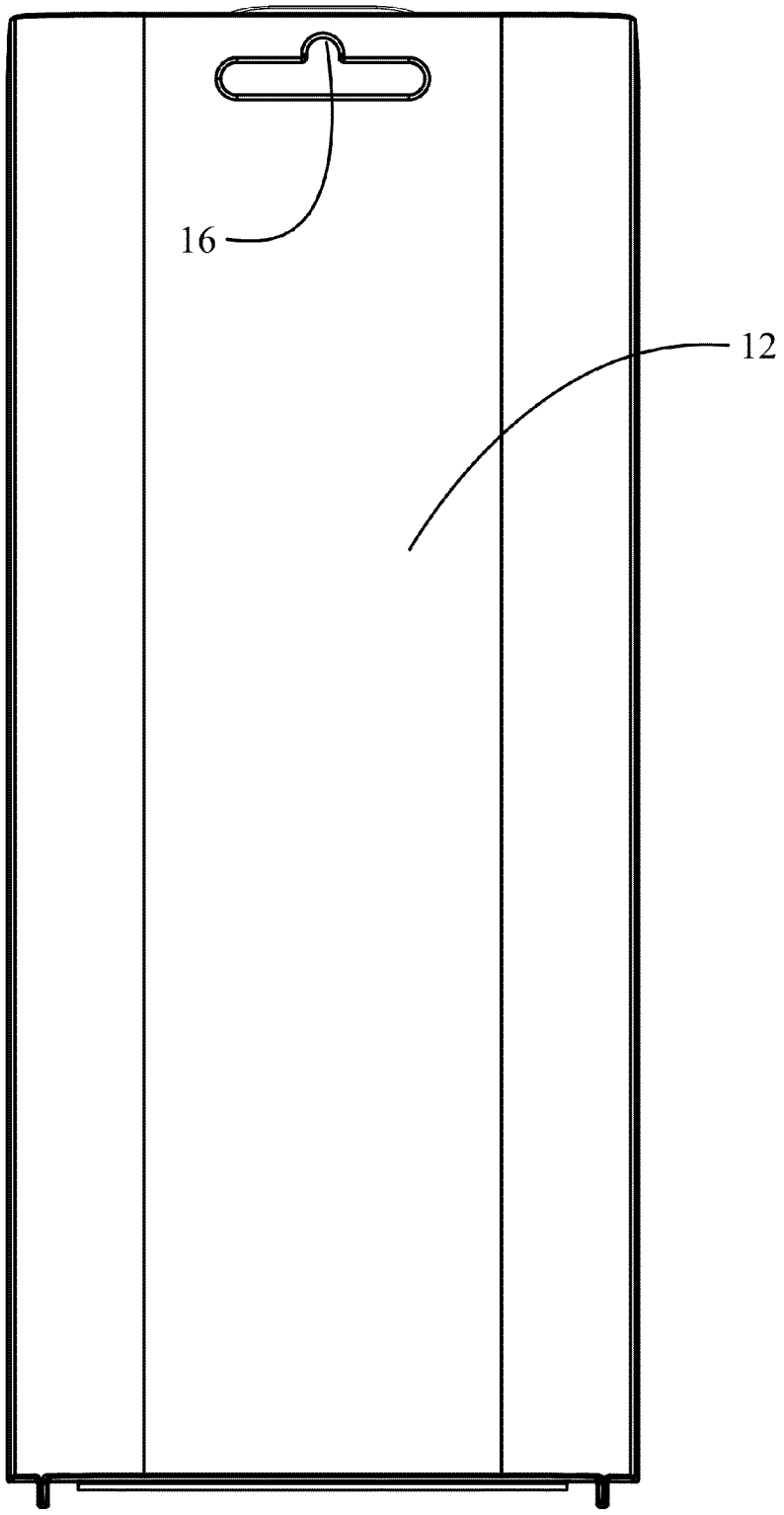
FIGS. 1B-1D are front, side and back views of the embodiment of FIG. 1A.
Figure 1C:
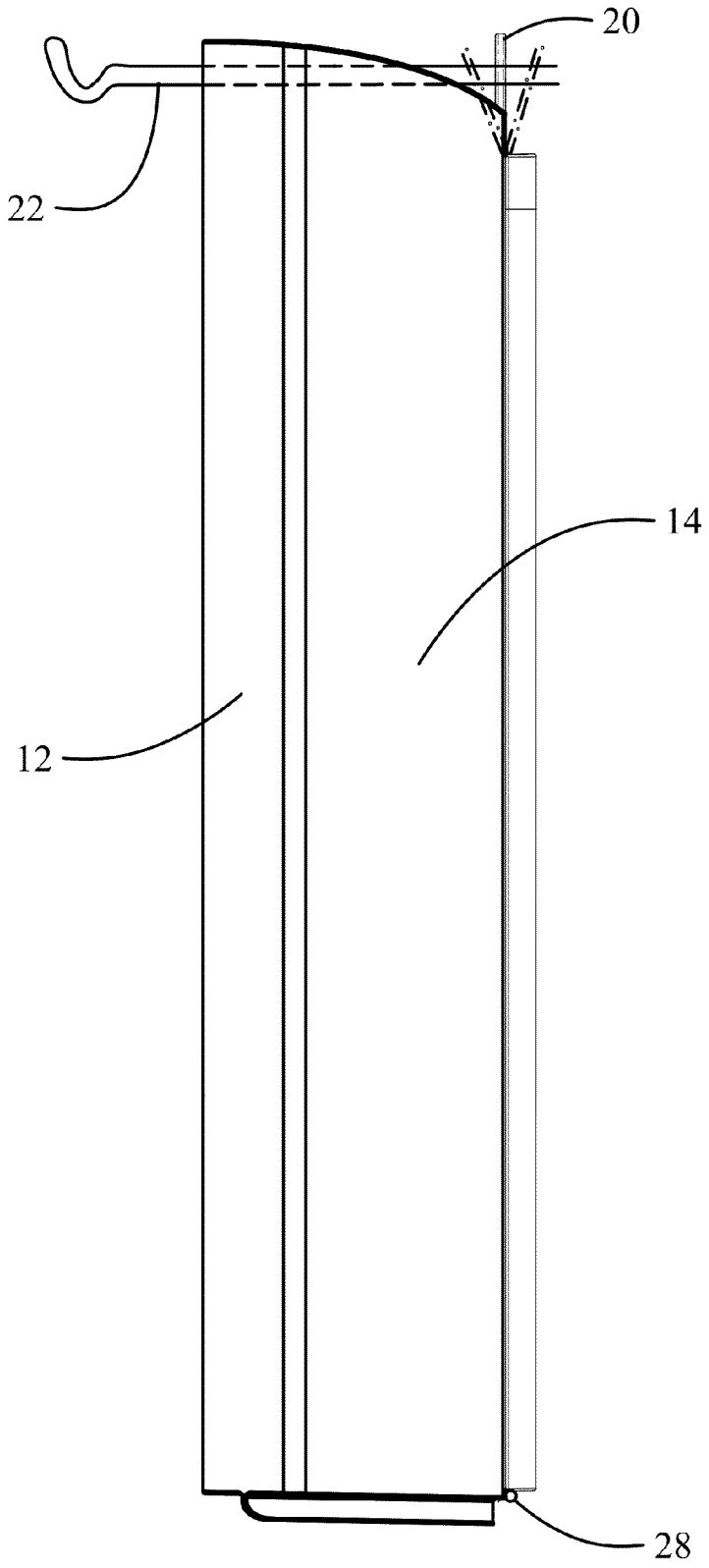
Figure 1D:
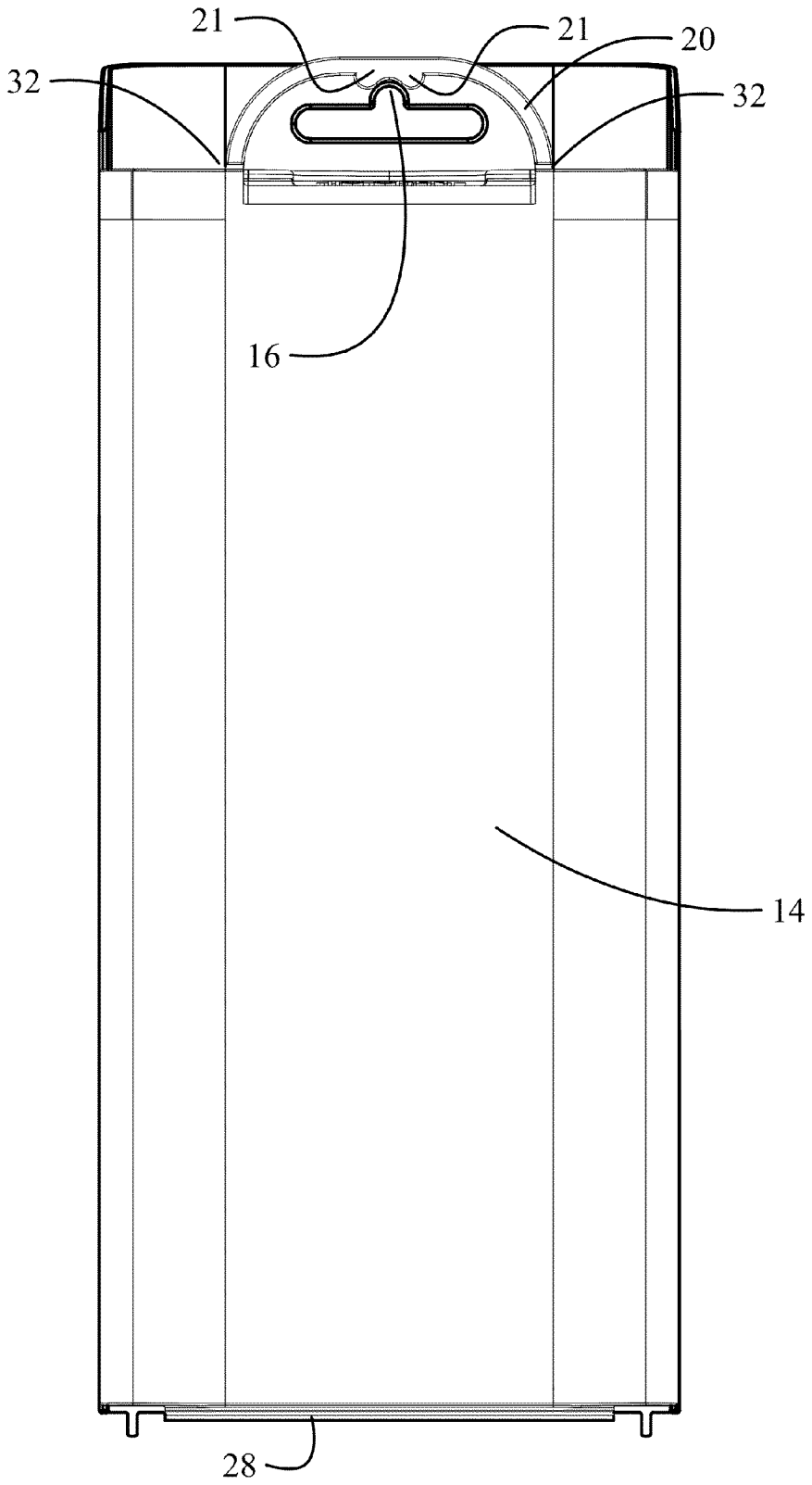
Figure 2:
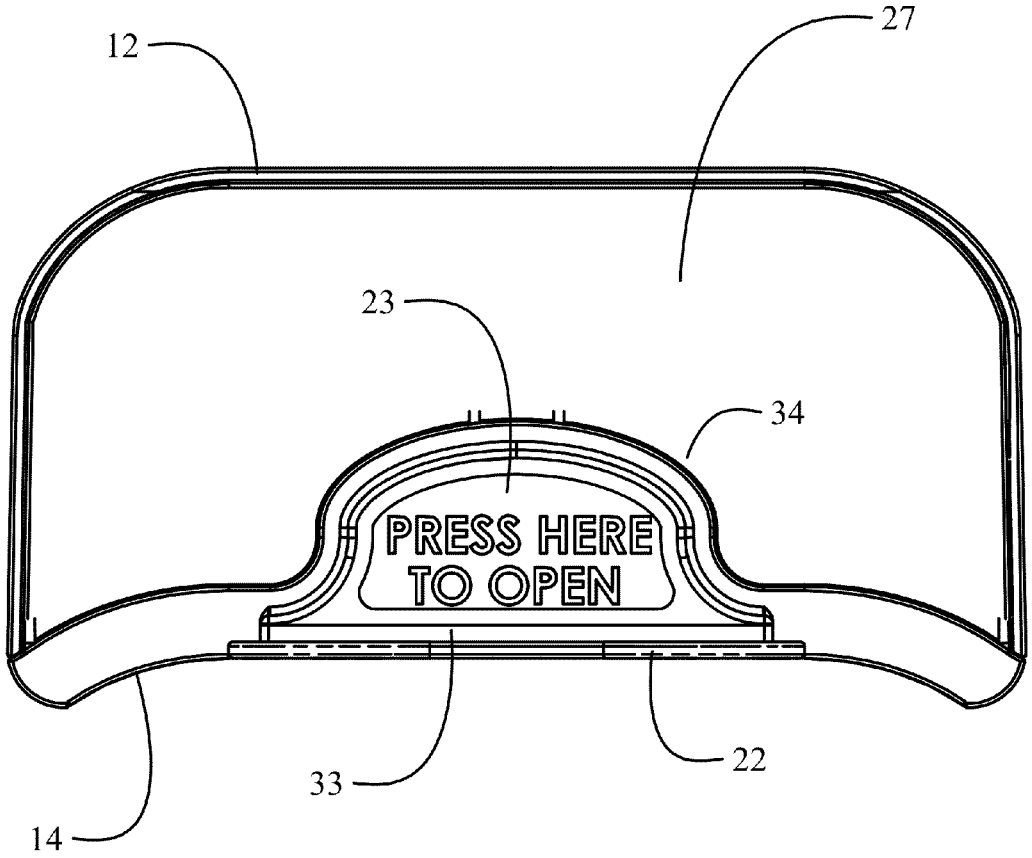
FIG. 2 is a top view of the embodiment of FIG. 1A
Figure 3:
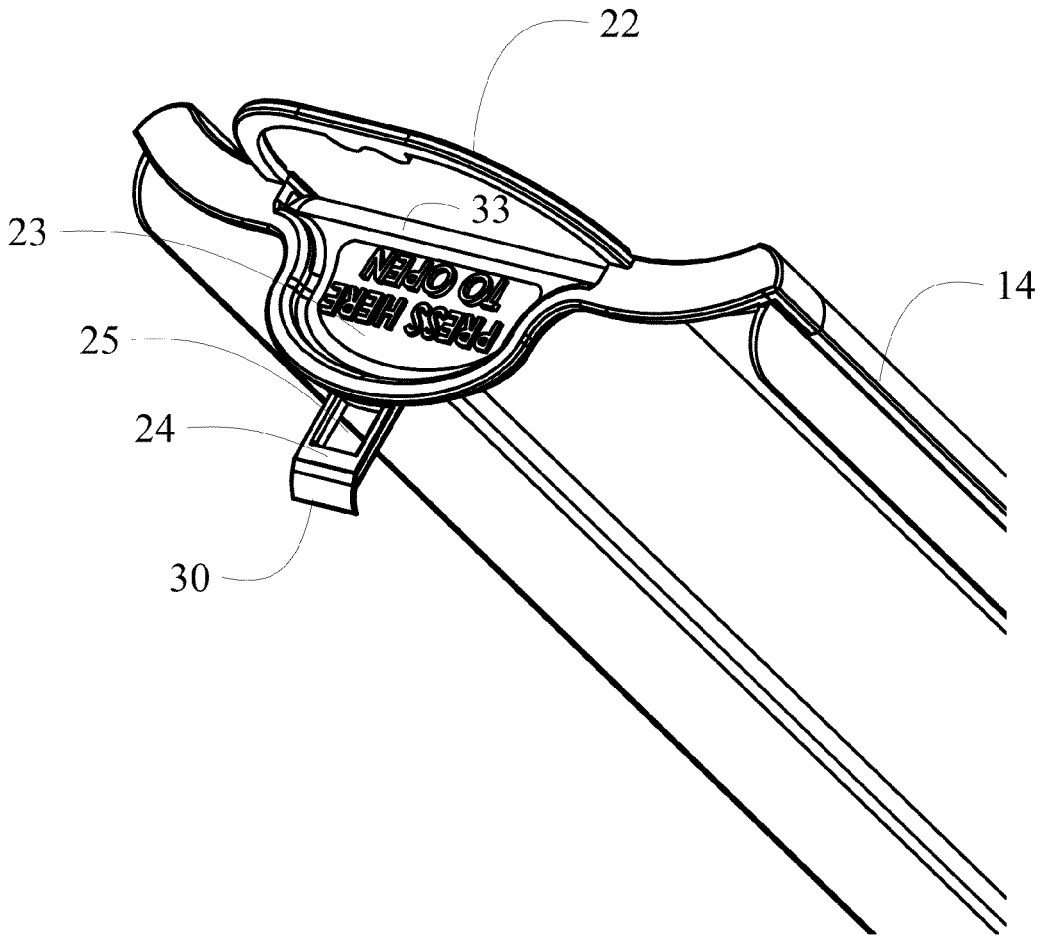
FIG. 3 is a detailed pictorial view of the rear portion of the box showing the push panel and lever arm actuating elements.
Figure 4:
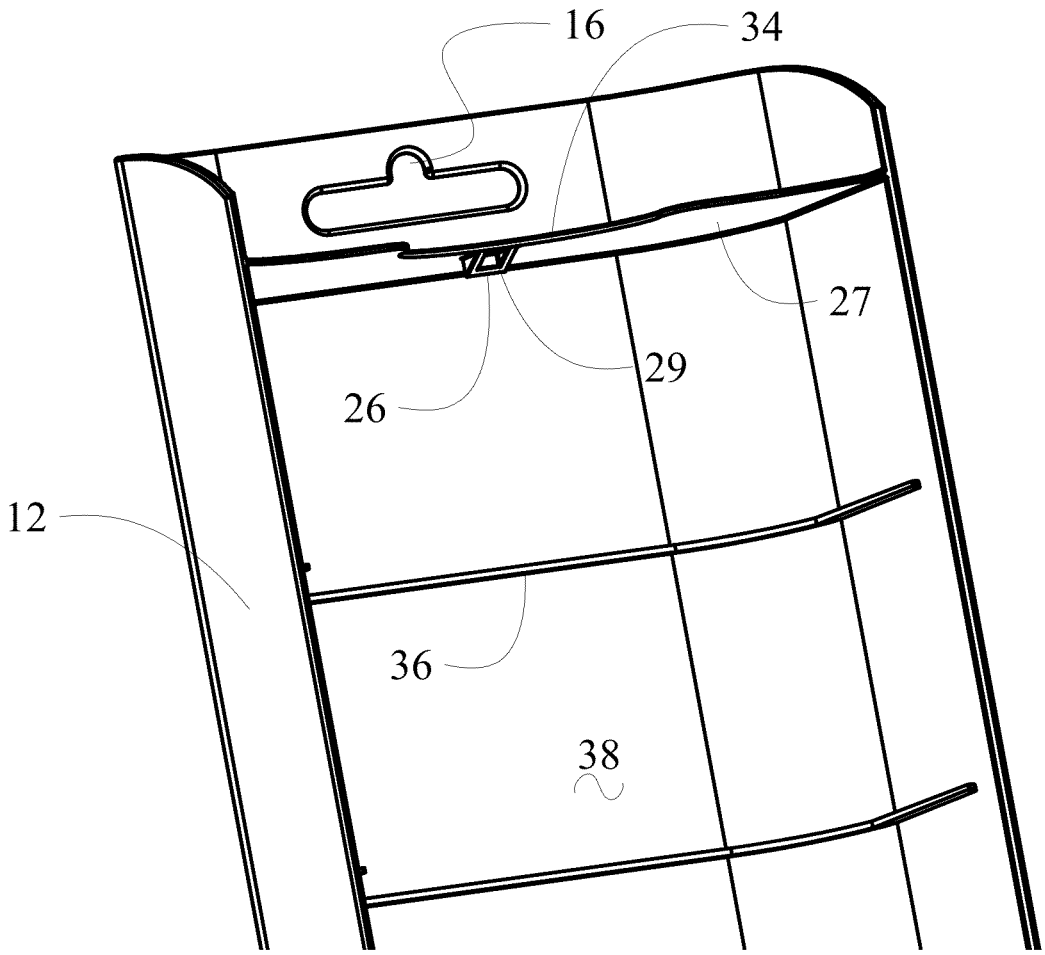
FIG. 4 is a detailed pictorial view of the front portion of the box showing the mating hook for the lever arm of FIG. 3 and the top rim with hanger bar receiver.

Referring to the drawings, a box 10 for retail display of goods is shown FIGS. 1A-1D. Unlike most packaging, the box is specifically designed to allow easy access to the product allowing the product to be removed from the box and, for the example of an orthopedic brace or similar product, testing of size and manipulation of the adjustment elements to assure that the product meets the needs of the customer prior to purchase. The box has a front portion 12 and a mating rear portion 14. The front portion 12 has a curved molded profile which provides structural rigidity while allowing a clear box to display the front and sides of the contained product. A molded front hanger bar receiver 16 is centered in a top rim 18 of the front portion 12. A flexible rear hanger bar receiver 20 extends from the rear portion 14 laterally displaced from the front hanger bar receiver with depending tabs 21 substantially aligned with the front hanger bar receiver to support the box in a vertical position aligned with and without "leaning" forward or backward at an angle from the hanger bar 22. in the embodiment shown, the front hanger bar receiver is an inverted T shaped aperture in the top rim 18 to allow insertion of a hooked hanger bar in the front hanger bar receiver by rotation of the box As seen in detail in FIGS. 2, 3 and 4, a push panel 23 operates a releasable engagement mechanism between the front and rear portions, which in the embodiment shown is an attached lever arm 24 extending from the push panel 23 and having a retention slot 25 to receive mating hook 26 depending from the upper panel 27 of the front portion 12. Depressing the push panel disengages the lever arm from the mating hook allowing the front and rear portions to be separated, rotating along hinge 28 (seen in FIGS. 1C). The mating hook 26 has a leading ramp 29 which engages a mating ramp 30 on the lever arm 24 to deflect the lever arm when closing the front and rear portions of the box. The push panel may be embossed to identify its function such as the "PRESS HERE TO OPEN" annotation in the drawings. The push panel additionally may be contoured to receive a user's thumb for placement to easily depress the push panel. The flexible rear hanger bar provides an arch 31 allowing a user to insert a finger through the arch to reach the push panel. The rear hanger bar 22 is also flexible to allow it to be displaced forward or backward (as shown in phantom in FIG. 1C) for the user to reach the push panel. As best seen in FIG. 1D, the attachments of rear hanger bar 22 to the rear portion 14 include relieved portions 32 to enhance the flexibility of the hanger bar.

Push panel 23 has a resilient living hinge 33 engaging the rear portion 14 and front portion 12 has an arcuate relief 34 in the upper panel 27 (best seen in FIGS. 4 and 5) to receive the push panel which has an arcuate profile. In alternative embodiments the profile of the push panel and relief may be a desired geometric shape adapted for consistency with the overall box shape. Resilient living hinge 33 urges the push panel into a substantially horizontal position from which the panel is displaced for release of the lever arm 24 and mating hook 26 and for reengagement when ramps 29 and 30 engage as previously described.

Figure 5:
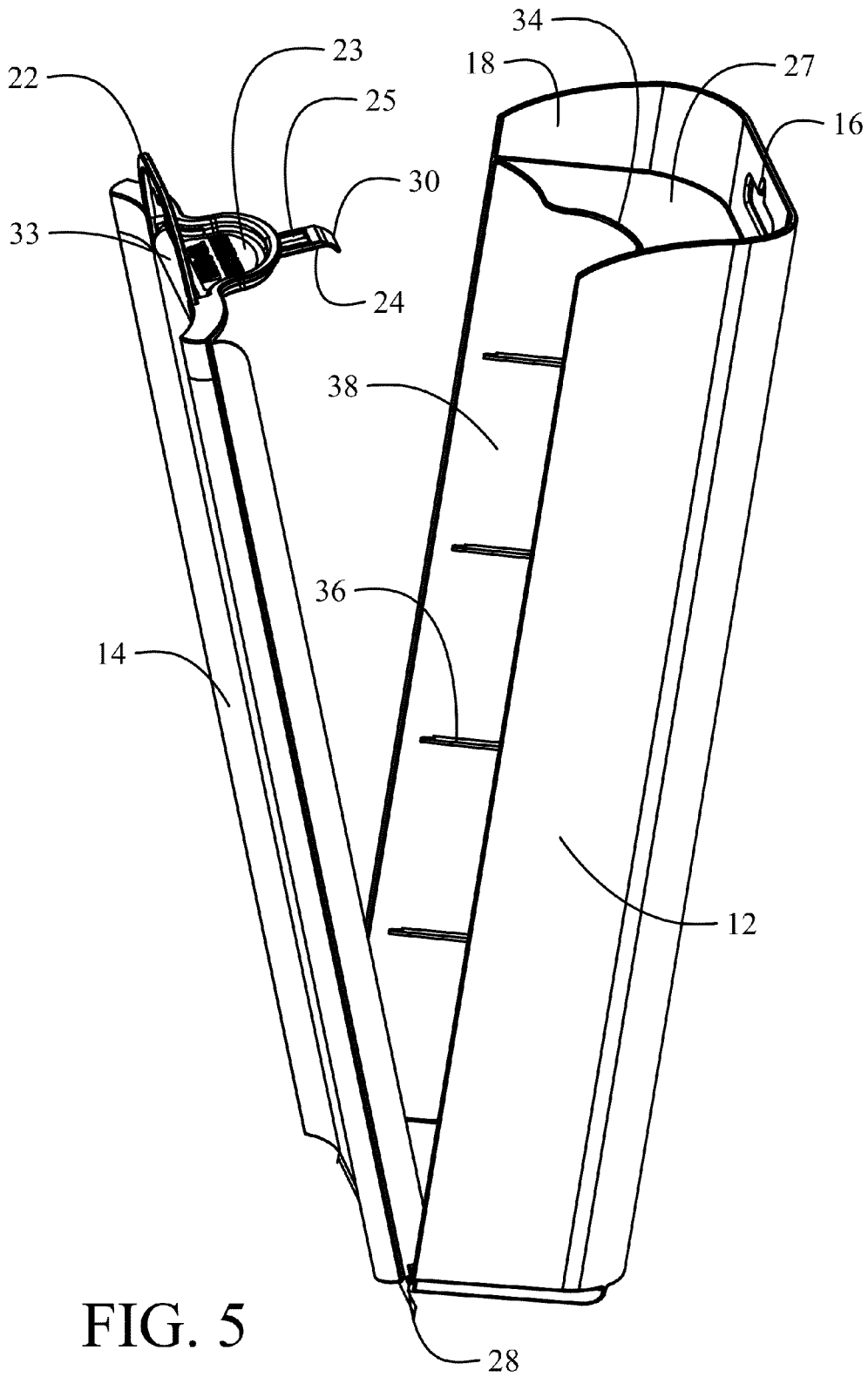
FIG. 5 is a pictorial view of the box in a partially open position.
Figure 6:
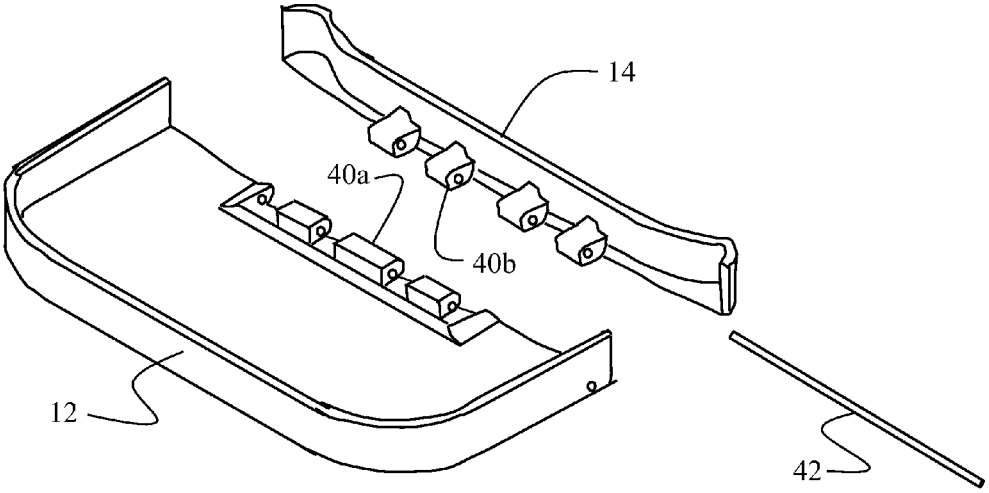
FIG. 6 is a truncated detailed exploded view of the front and rear portions with a piano hinge for an exemplary embodiment.

As seen in FIG. 5, the box 10 is designed to allow easy opening to extract and view the product. The front portion 10 and mating rear portion are connected with hinge 28. As seen in FIG. 5, structural ribs 36 may be provided on an inner surface 38 of the front portions for added structural support. In various embodiments the hinge 28 may be a "living hinge" of thinned material extending between front portion 12 and rear portion 14, a piano hinge as shown in FIG. 6 having interlocking elements 40*a* and 40*b* with aligning central bores to receive a pin 42 or comparable interlocking elements.

Having now described various embodiments of the disclosure in detail as required by the patent statutes, those skilled in the art will recognize modifications and substitutions to the specific embodiments disclosed herein. Such modifications are within the scope and intent of the present disclosure as defined in the following claims.

What is claimed is:

1. An accessible display box comprising:

a front portion attached to a rear portion with a hinge;

a front hanger bar receiver centered in a top rim of the front portion;

a rear hanger bar receiver extending from the rear portion, said rear hanger bar receiver aligned with the front hanger bar receiver;

a releasable engagement mechanism having a push panel resiliently attached to the rear portion;

a lever arm including a retention slot extending from the push panel;

a mating hook securing the front portion and rear portion, said mating hook depending from an upper panel on the front portion engaged by the lever arm wherein depression of the push panel releases the lever arm from the mating hook, the upper panel including an arcuate relief receiving the push panel.

2. The accessible display box as defined in claim 1 wherein the mating hook incorporates a leading ramp and the lever arm terminates in a mating ramp engaged by the leading ramp to deflect the lever arm for engagement of the mating hook in the retention slot.

3. The accessible display box as defined in claim 1 wherein the push panel engages the rear portion in a living hinge.

4. The accessible display box as defined in claim 1 wherein the rear hanger bar receiver incorporates an arch for access to the push panel.

5. The accessible display box as defined in claim 1 wherein the rear hanger bar receiver is resiliently flexible forward and rearward for access to the push panel.

6. The accessible display box as defined in claim 1 wherein the rear hanger bar receiver has depending tabs substantially aligned with the front hanger bar receiver for alignment of the hanger bar.

7. The accessible display box as defined in claim 6 wherein the front hanger bar receiver is an inverted T shaped aperture.

8. The accessible display box as defined in claim 1 wherein the hinge comprises a living hinge intermediate the front portion and back portion.

9. The accessible display box as defined in claim 1 wherein the hinge comprises a piano hinge.

10. The accessible display box as defined in claim 9 wherein the piano hinge incorporates interlocking elements with aligning bores receiving a hinge pin.

* * * * *